US011242228B2

(12) United States Patent
Hartmann

(10) Patent No.: US 11,242,228 B2
(45) Date of Patent: Feb. 8, 2022

(54) METHOD OF MOVING A LOAD USING A CRANE

(71) Applicant: Liebherr-Werk Ehingen GmbH, Ehingen (DE)

(72) Inventor: Andreas Hartmann, Allmendingen (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 204 days.

(21) Appl. No.: 16/125,351

(22) Filed: Sep. 7, 2018

(65) Prior Publication Data

US 2019/0084808 A1 Mar. 21, 2019

(30) Foreign Application Priority Data

Sep. 7, 2017 (DE) ..... 10 2017 120 613.2

(51) Int. Cl.
*B66C 13/46* (2006.01)
*B66C 15/04* (2006.01)
*B66C 13/48* (2006.01)

(52) U.S. Cl.
CPC ..... *B66C 13/46* (2013.01); *B66C 15/04* (2013.01); *B66C 15/045* (2013.01); *B66C 13/48* (2013.01)

(58) Field of Classification Search
None
See application file for complete search history.

(56) References Cited

U.S. PATENT DOCUMENTS

| | | | | |
|---|---|---|---|---|
| 8,909,467 | B2 * | 12/2014 | Lee | G01S 19/51 701/301 |
| 9,300,954 | B2 * | 3/2016 | Tanizumi | B60R 1/00 |
| 9,944,499 | B2 | 4/2018 | Schoonmaker et al. | |
| 2013/0345938 | A1 * | 12/2013 | Ruoss | B66C 13/18 701/50 |
| 2017/0089032 | A1 * | 3/2017 | Hokkanen | G01S 19/14 |
| 2018/0319633 | A1 * | 11/2018 | Behnke | B66C 13/08 |

FOREIGN PATENT DOCUMENTS

| | | | |
|---|---|---|---|
| CN | 101723248 | * | 6/2010 |
| DE | 112012000169 | T5 | 7/2013 |
| DE | 102015218686 | A1 | 3/2017 |
| EP | 2560140 | A1 | 2/2013 |
| EP | 3037376 | A1 | 6/2016 |

* cited by examiner

*Primary Examiner* — Yuen Wong
*Assistant Examiner* — Hongye Liang
(74) *Attorney, Agent, or Firm* — McCoy Russell LLP

(57) ABSTRACT

The present invention relates to a method of moving a load using a crane comprising the steps: defining an origin coordinate system in the crane; defining at least one obstacle coordinate system that is fixedly linked to a deployment location of the load movement; establishing a relationship of the at least one obstacle coordinate system with the origin coordinate system; predefining a travel path of the hook block, preferably with the suspended load, with the aid of the at least one obstacle coordinate system; and converting the travel path from the obstacle coordinate system into actuator controls of the crane for a corresponding movement of the hook block, preferably with the suspended load.

17 Claims, 12 Drawing Sheets

METHOD OF MOVING A LOAD USING A CRANE

CROSS REFERENCE TO RELATED APPLICATIONS

This application claims priority to German Patent Application No. 10 2017 120 613.2 filed Sep. 7, 2017, entitled "VERFAHREN ZUM BEWEGEN EINER LAST MIT EINEM KRAN," the entire contents of which are hereby incorporated by reference in their entirety for all purposes.

TECHNICAL FIELD

The present invention relates to a method of moving a load using a crane and to a corresponding crane for this purpose.

BACKGROUND AND SUMMARY

It is often difficult with cranes to guide a load suspended at a crane hook around obstacles such as building edges or similar. Straight-line travel movements of the lifting hook are namely often required here in which a crane operator has to simultaneously control a number of crane actuators at different speeds. This is mostly only possible for experienced and well-trained crane operators, but typically represents a challenging task for them. It can thus be necessary that a luffing movement, a hoisting movement, a rotation of the superstructure of the crane, and a telescopic movement of the crane boom are simultaneously necessary for a straight-line movement of the lifting hook and of the load suspended thereat. A straight-line movement can be carried out at a constant load height by a simultaneous control of the above-named movements.

It is the aim of the present invention also to make such straight-line movements, such as typically occur on the traveling around an obstacle with the lifting hook at a deployment location of the crane, possible for less practiced crane operators so that demanding load movements can also be carried out without time delays and the work routines associated with a crane can be accelerated.

The above-mentioned problems are overcome with the aid of a method that has all the features of claim 1.

In accordance with the method in accordance with the invention for moving a load using a crane, an origin coordinate system is defined in the crane, an obstacle coordinate system is defined that is fixedly linked to a deployment location of the load movement, a relationship of the at least one obstacle coordinate system with the origin coordinate system is established, a travel path of the hook block at which a load is preferably suspended is predefined and the travel path is converted from the obstacle coordinate system into actuator controls of the crane for a corresponding movement of the load.

It is advantageous here that the travel path of the load is predefined with the aid of the spatially fixed obstacle coordinate system, that is, for example, by an input via a touch-sensitive display, whereby the necessity of inputting parallel control pulses of the plurality of crane drives that differ in their speeds is dispensed with. The individual control pulses are obtained with the aid of a conversion from the obstacle coordinate system that produces as its result the actuator controls of the plurality of actuators of the crane for a corresponding movement in the spatially fixed obstacle coordinate system. Complicated load movements are also possible without problem since the inputting of the travel path with the aid of the spatially fixed obstacle coordinate system is also easily understandable for unpracticed crane operators. The desired travel path can thus, for example, be input from a bird's eye view of the crane deployment location.

Provision can preferably be made that the position, and preferably the orientation, of the load to be moved are furthermore detected in the obstacle coordinate system.

In accordance with an advantageous modification of the invention, the actuator controls for moving the load comprise the individual or common actuation of a luffing movement, of a rotational movement of the superstructure of a crane and/or a telescopic movement of a crane boom.

The present invention is not restricted to the above-named exemplary crane movements, but can also furthermore include crane movements and control commands that are not listed, but that are advantageous on the traveling of a load. It is clear to the skilled person that all the degrees of freedom of the crane to be made use of for a movement of the load can be used.

Provision is furthermore preferably made in accordance with the method that, if the travel path is to be implemented by means of a plurality of actuator control sets, the final set of actuator controls is reached on the basis of specifications that preferably comprise a maximum payload, a maximum speed and/or a minimal energy consumption.

It can thus occur that the travel path to be converted can be carried out by different combinations of crane movements. To resolve such an ambiguity, a travel path is then selected that is optimized with respect to a specification and that, for example, has the greatest payload reserves or permits the highest travel speed.

Provision can further be made that in accordance with the method in accordance with the invention the origin coordinate system is furthermore fixedly linked to the crane and the spatial relationship of the origin coordinate system and the obstacle coordinate system is advised to a crane control. Provision can also be made here that the origin coordinate system is at the center of a slewing ring of the crane.

Since the spatial relationship of the origin coordinate system, that is, the position and orientation of the crane, with respect to the obstacle coordinate system is advised to a crane control, the latter is now able to enter the orientation and the location of the crane into the obstacle coordinate system. The obstacle coordinate system thus also comprises the crane itself in addition to the special topographical and construction features of the crane environment and of the load and can thus carry out payload calculations and the like in a simple manner since the position and orientation of all the relevant objects are known in the obstacle coordinate system.

Provision can further be made that a hook block coordinate system is furthermore defined that is fixedly linked to the hook block of the crane, with a displacement and a rotation of the hook block coordinate system preferably being able to be calculated back to the origin coordinate system fixedly linked to the crane, preferably by the crane control. Since the hook block coordinate system can always be brought into a spatial relationship with the origin coordinate system of the crane due to the positionings of the actuators by the crane control, it is possible to travel to specific characteristic points of the obstacle coordinate system with the hook block or with the hook block coordinate system linked thereto and thus to advise one or more characteristic points of the obstacle coordinate system to the crane control in an uncomplicated manner. It is thereby possible also to correctly include the obstacle coordinate system in the crane control with mobile cranes. This is done, for example, by the perpendicular arrangement of the hook block above a characteristic point of the origin of the obstacle coordinate system (such as a building edge or the like). The crane control receives the required information to correctly position or to enter the obstacle coordinate system into the origin coordinate system fixedly linked to the crane with the knowledge of the controls of the crane required for this hook block position. The calibration of the obstacle with the hook block takes place in the initially present origin coordinate system of the crane. An obstacle coordinate system results on the calibration of the obstacle that thus has a relationship with the origin coordinate system and can be entered into it.

Provision can furthermore be made that a camera is used to define or make known the obstacle coordinate system in the crane control (or in the origin coordinate system), with the hook block coordinate system preferably being aligned superposed with the obstacle coordinate system not yet known to the crane for making the obstacle coordinate system known in a crane control of the crane. If the hook block coordinate system is at the correct position due to an operator input and if it is also correctly aligned, the adopted position and alignment of the hook block coordinate system can be fixed as the origin of the obstacle coordinate system and can be entered into the origin coordinate system by a further operator input. A fast overview can also be quickly obtained in a simple manner with the aid of the camera as to whether the obstacle coordinate system origin set at a characteristic feature of the obstacle coordinate system is congruent with the origin of the hook block coordinate system. Since the orientation of the obstacle coordinate system is also fixed with the aid of the characteristic features of the deployment location (for example with the aid of a building edge or building corner), the obstacle coordinate system can thus be unambiguously advised to the crane control.

In an advantageous embodiment of the method, the known hook block coordinate system is duplicated in a camera image shown on a screen. This duplicate is suitably rotated and moved with the aid of user inputs, preferably via button operation. If it is at the correct position, it becomes the obstacle coordinate system. This is preferably done in that the current location (preferably orientation and position) of the hook block coordinate system is fixed via user input as the origin of the obstacle coordinate system that is then fixedly arranged in the origin coordinate system.

In accordance with the method in accordance with the invention, it is accordingly further possible to use characteristic features of the deployment location, preferably a building edge or another special topographical or construction feature at the deployment location, for the alignment of the hook block coordinate system at the obstacle coordinate system. The obstacle to be traveled around by the load is preferably used for this purpose. It is accordingly possible for the crane control to enter the crane with its origin coordinate system into the obstacle coordinate system and thus to carry out desired travel movements of a load that are input in the obstacle coordinate system with the help of a conversion. The obstacle coordinate system preferably corresponds to a site plan and/or to a construction site plan.

Provision can further be made that the origin of the hook block coordinate system is used to detect the obstacle coordinate system in the crane control in order thereby to make the origin of the obstacle coordinate system and a point of an axis on the obstacle coordinate system known to the crane control (for example, in a 2D system or in a 3D system, a respective point on 2 axes). The orientation and the location of the obstacle coordinate system are thereby supplied to the crane control in an unambiguous manner.

Provision can further be made that radio GPS transmitters are used to detect the obstacle coordinate system in the crane control that permit a conclusion to be drawn on the orientation and location of the obstacle coordinate system in cooperation with a radio GPS receiver of a crane control of the crane present at the crane.

In accordance with a further optional modification of the method, the crane is arranged in the obstacle coordinate system before the specification of the travel path of the load by an operator of the crane and furthermore a payload calculation of the crane is carried out for the desired travel path before the specification of the travel path of the load. Since the exact position of the crane in the obstacle coordinate system can be made known to the crane control in the course of the process, it is then also possible to carry out a payload calculation applicable to the present situation that is not based on planned or estimated probable locations of the crane. Nor is it necessary to exactly travel to the crane location on the construction site used beforehand for a payload calculation.

It is furthermore possible in accordance with a modification of the present method that a tandem hoist of two cranes is provided for the movement of the load. The origin coordinate systems of both cranes are here used in a common obstacle coordinate system, preferably by one of the above-named variants.

Provision can be made here that both cranes are coupled to one another before a traveling of the load via a data link that is used to transmit the coordinates of the hook block of the one crane (preferably in the obstacle coordinate system) to the other crane. The other crane can then coordinate its movements thereto.

BRIEF DESCRIPTION OF THE FIGURES

Provision is preferably made that the other crane moves the position of its hook block in dependence on the coordinates in the obstacle coordinate system of the hook block of the first crane and in dependence on the desired orientation of the load.

The present invention further comprises an apparatus, in particular an apparatus for carrying out a method in accordance with one of the variants listed above, said apparatus comprising: a crane for moving a load, a crane control for controlling actuators, a coordinate system detection means for detecting and fixing the position and orientation of the crane in a spatially fixed obstacle coordinate system that is fixedly linked to a deployment location of the crane, with the crane control being configured to travel a load on the basis of the detected position and orientation of the crane in the obstacle coordinate system.

DETAILED DESCRIPTION

The crane control is preferably configured to carry out a payload calculation for a load detected in the obstacle coordinate system or for a load movement after the detection and fixing the position and the orientation of the crane in the spatially fixed obstacle coordinate system.

The coordinate system detection means can here be a hook block whose exact position and orientation with respect to the origin coordinate system of the crane is known to the crane control. The origin coordinate system is here fixedly associated with the crane and is typically at the center of the slewing ring, with the longitudinal extent of the crane being in parallel with the Y axis and with the width direction of the crane being in parallel with the X axis.

It is clear to the skilled person that a plurality of obstacle coordinate systems can also be stored in the origin coordinate system.

The "obstacle coordinate system" can furthermore also be a useful obstacle coordinate system such as a low loader on which the load is to be placed. The obstacle coordinate system can here be at any desired point of the construction site or in the origin coordinate system and can in so doing mark any kind of obstacle.

Figure 1:
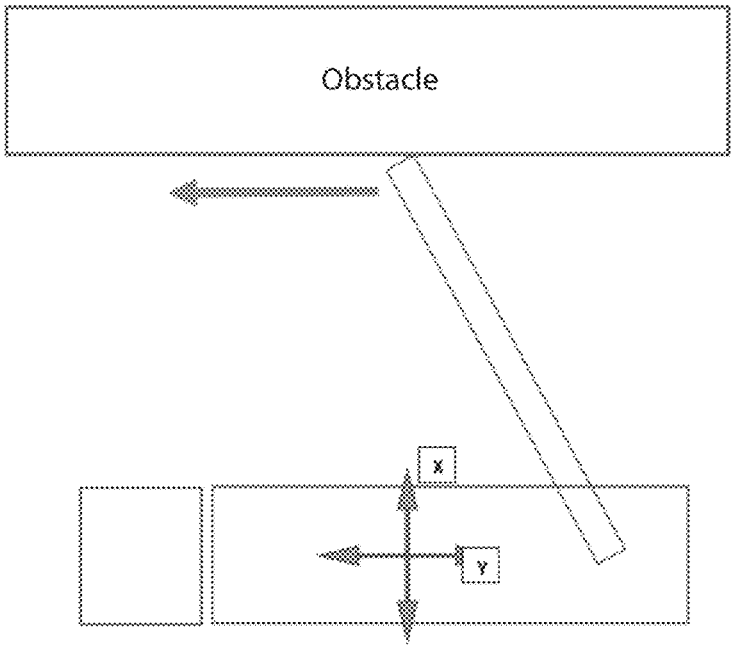
Figure 2:
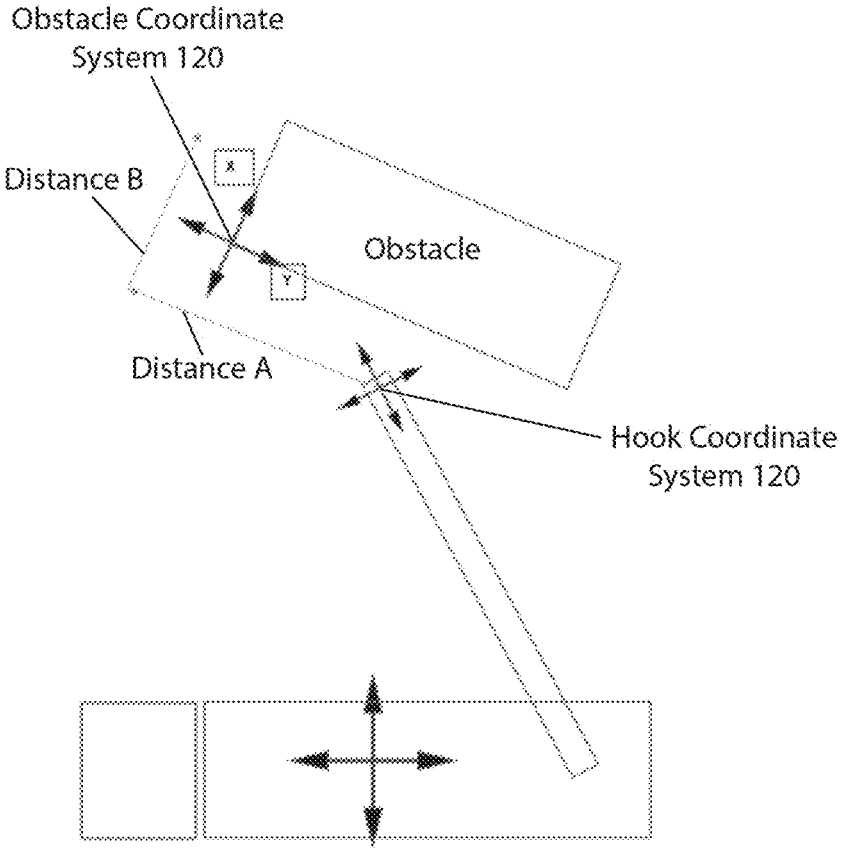
Figure 3:
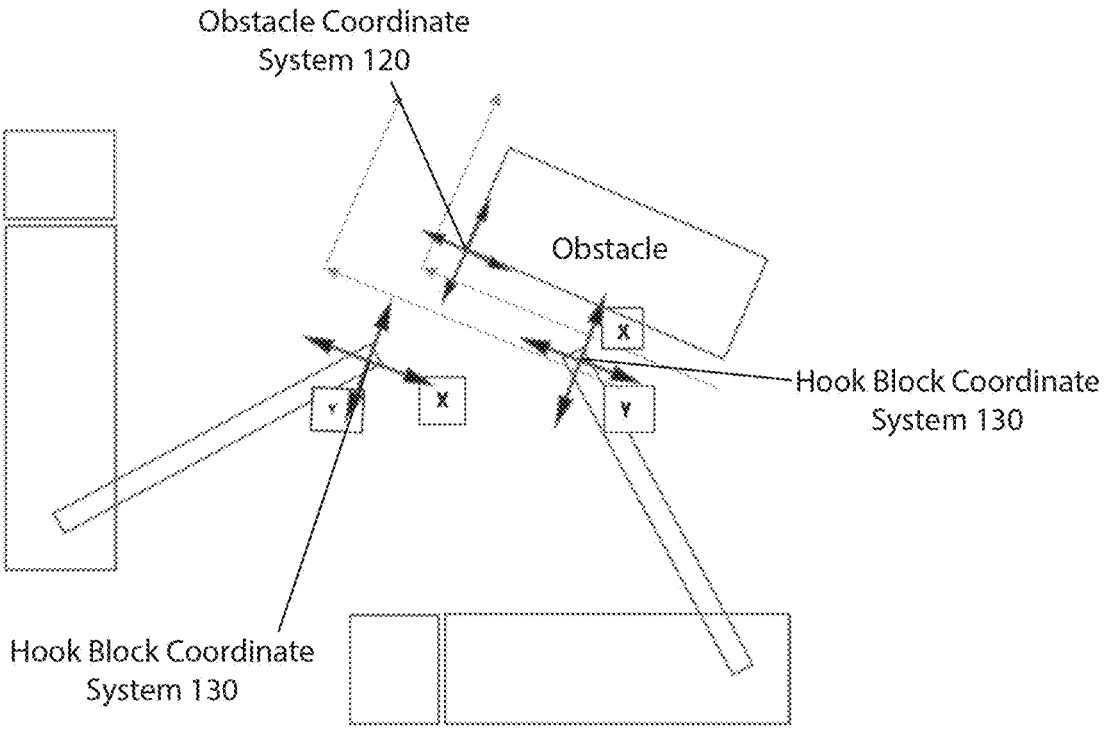
Figure 4A:
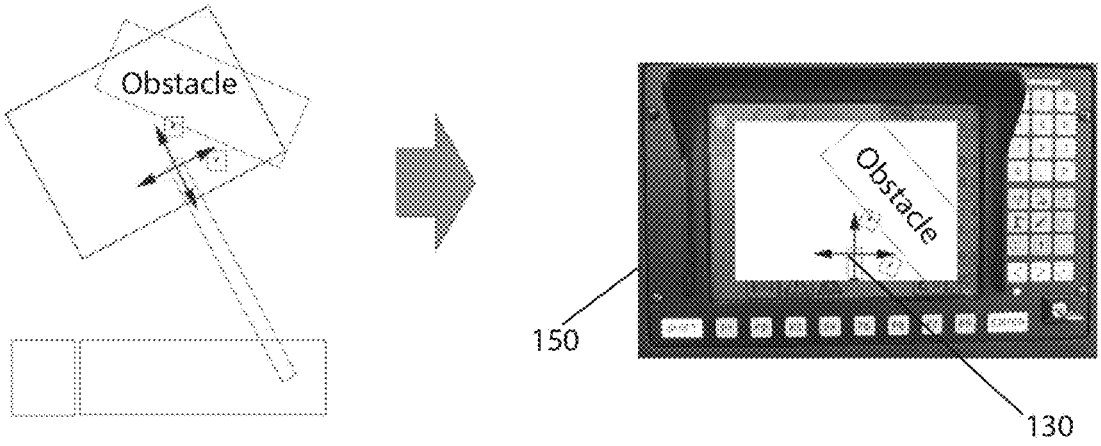
Figure 4B:
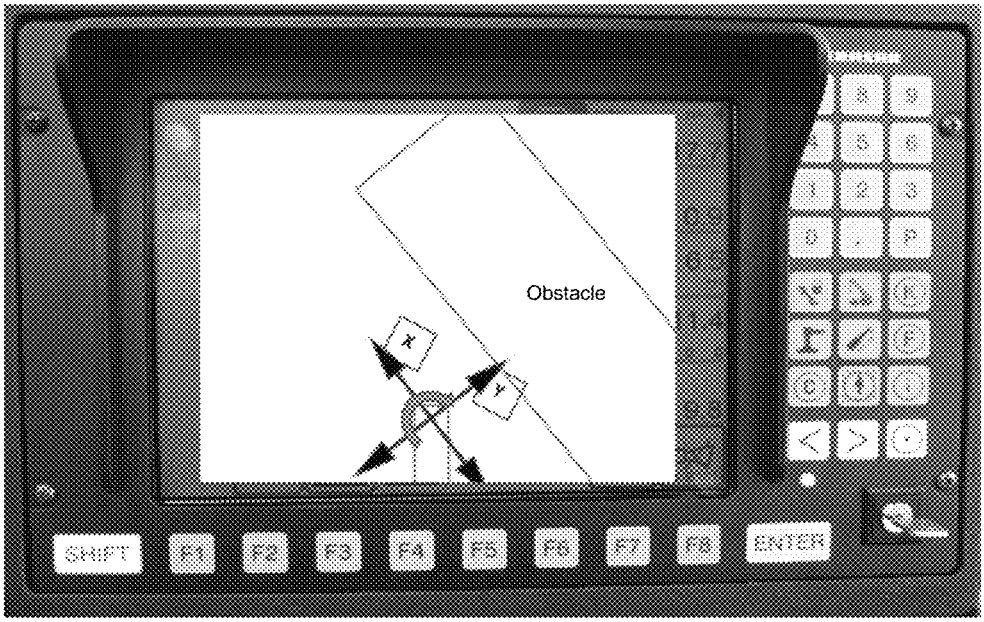
Figure 4C:
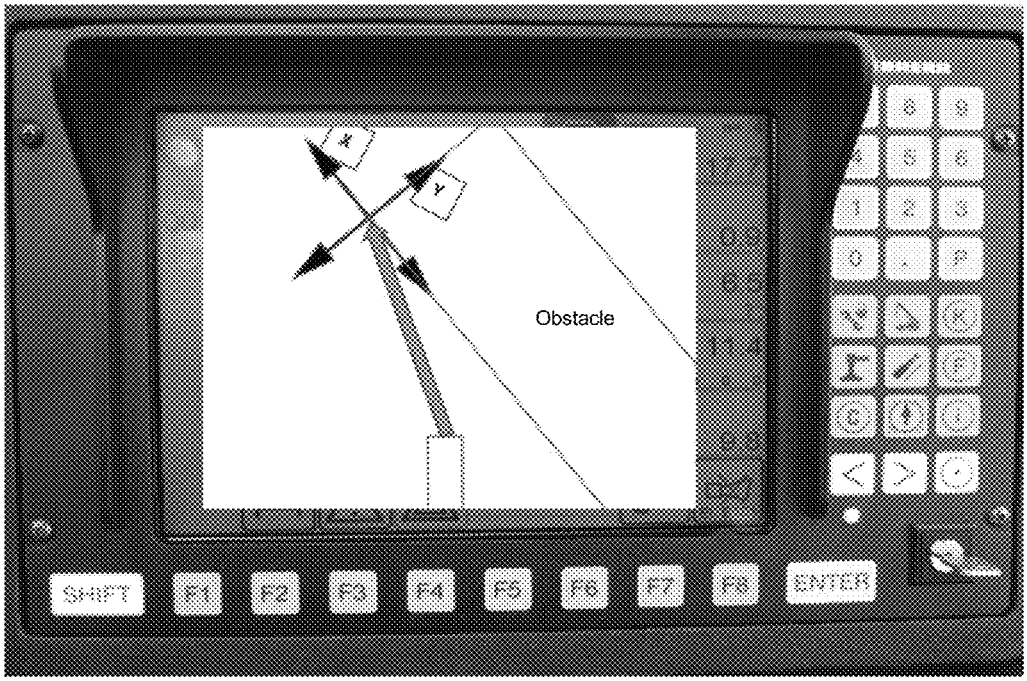
Figure 5:
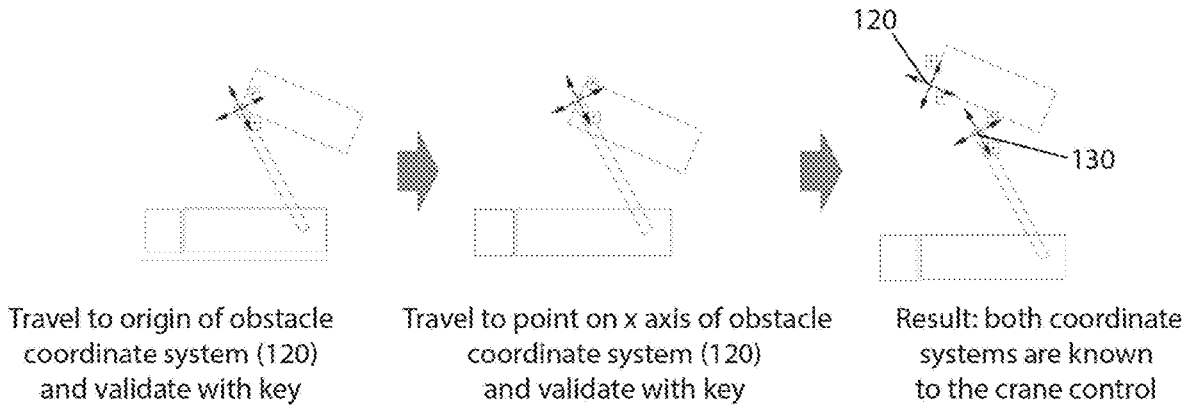
Figure 6:
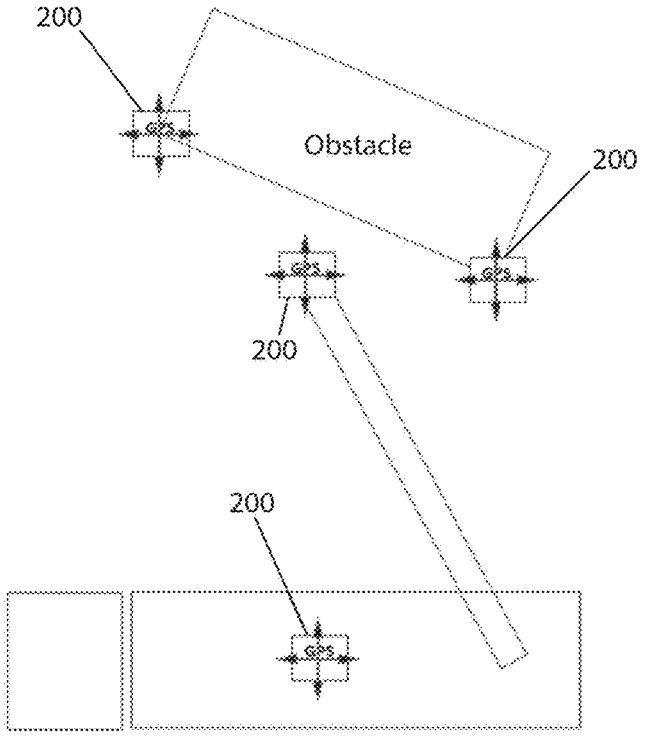
Figure 7A:
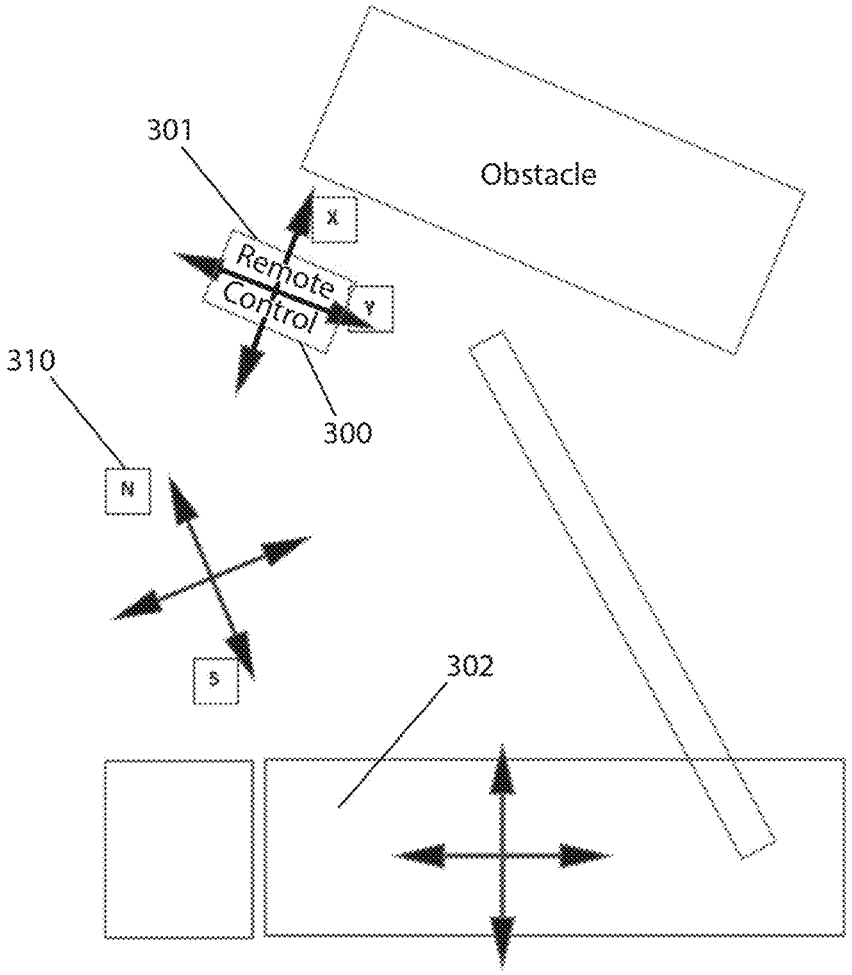
Figure 7B:
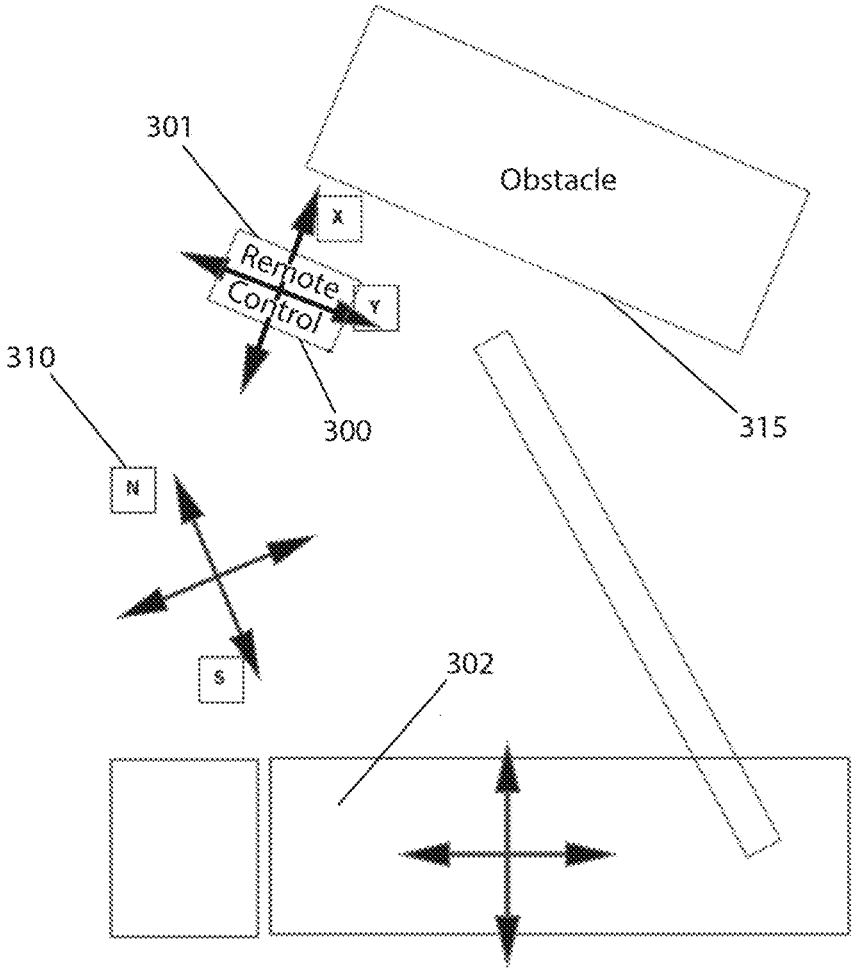
Figure 8A:
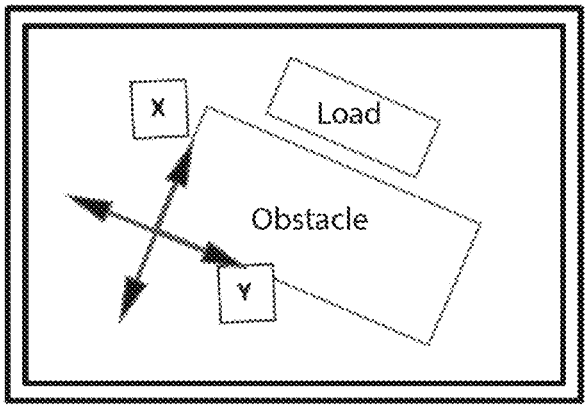
Figure 8B:
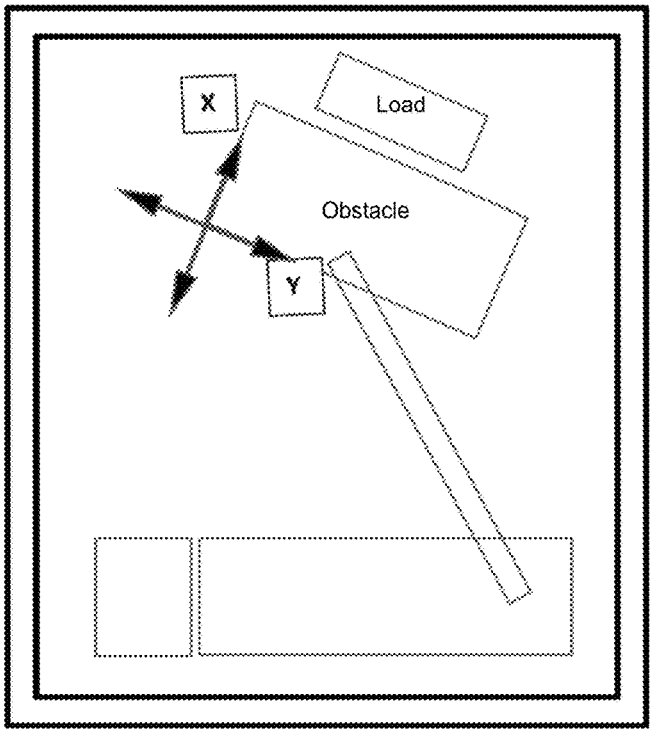
Figure 8C:
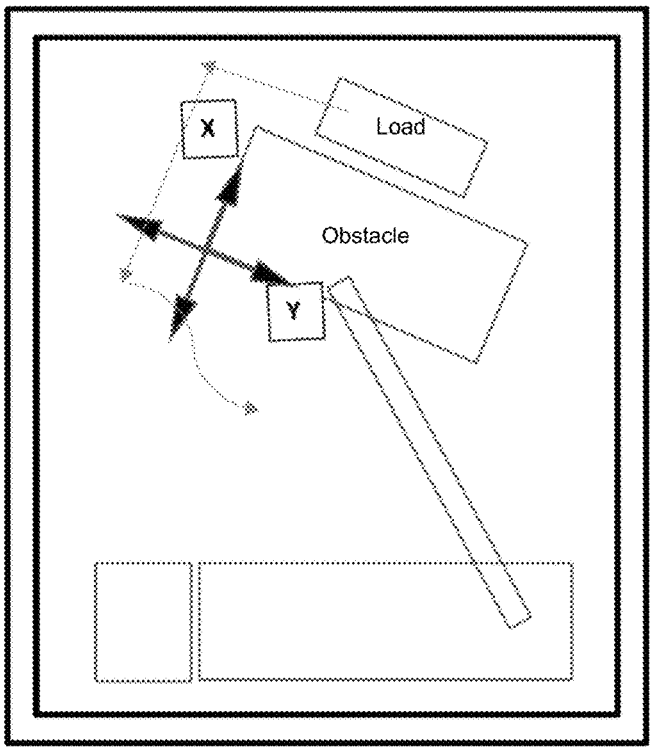
Figure 9A:
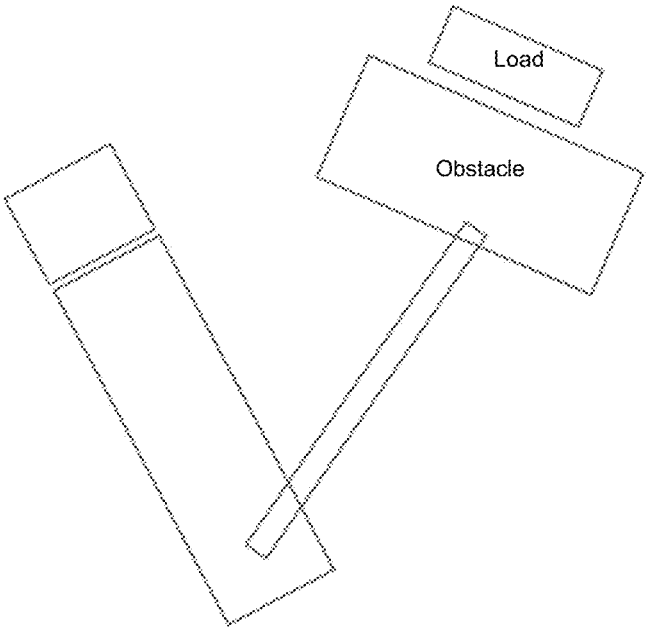
Figure 9B:
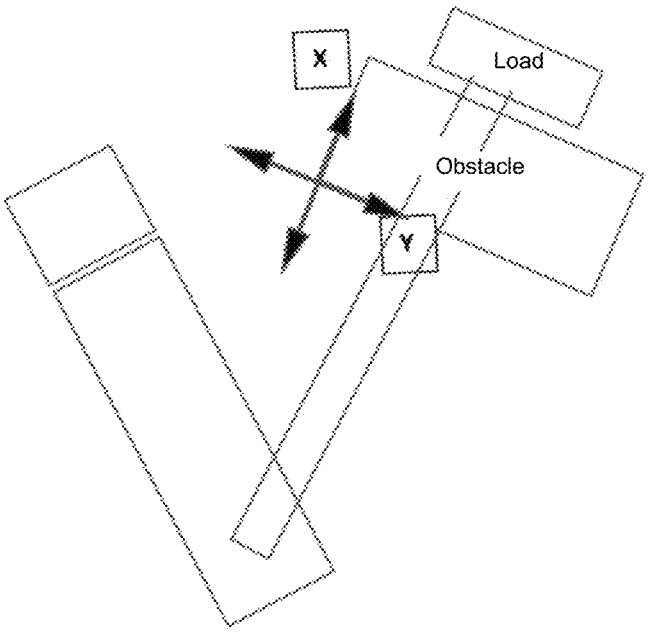
Figure 9C:
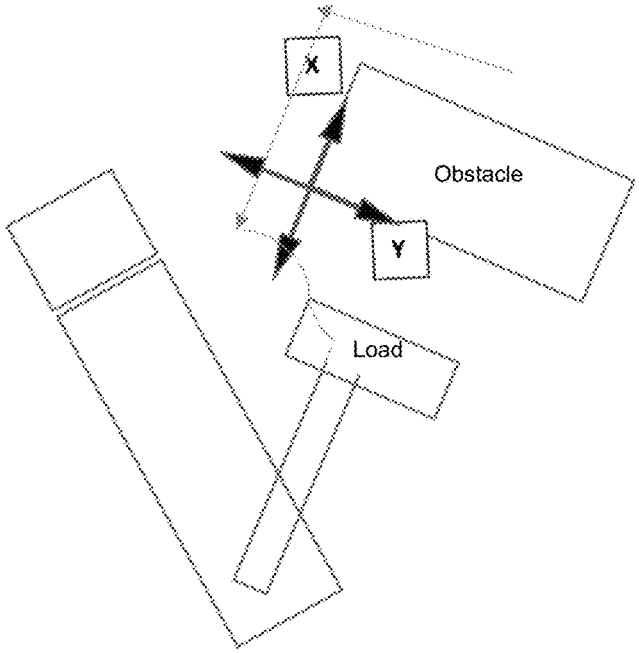
Figure 10A:
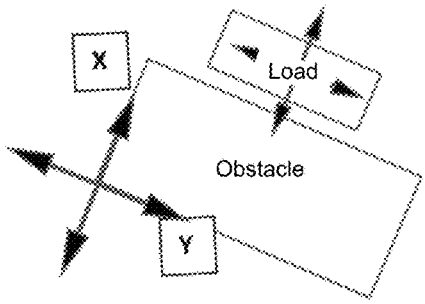
Figure 10B:
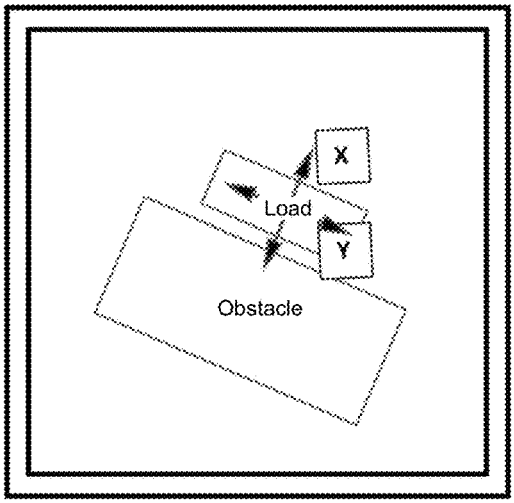
Figure 10C:
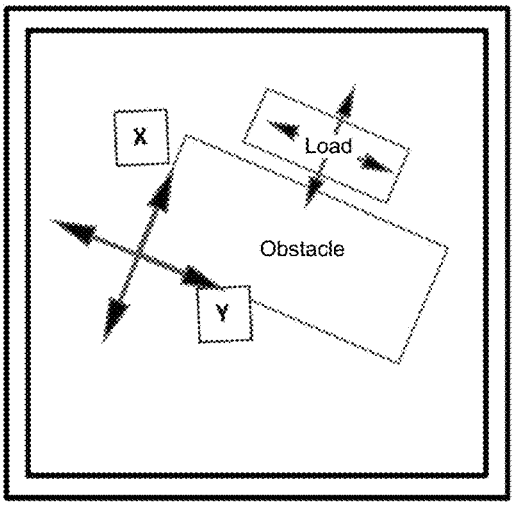
Figure 10D:
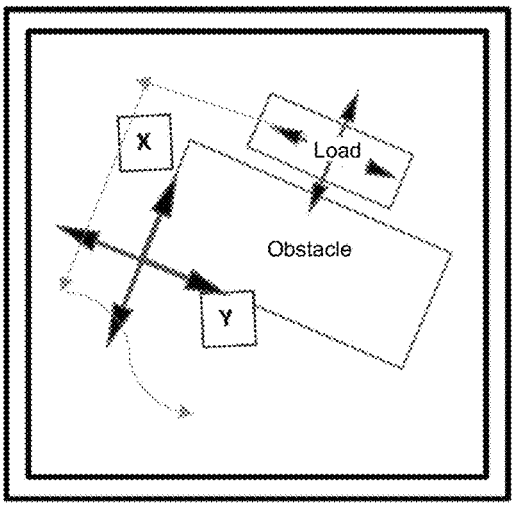
Figure 11A:
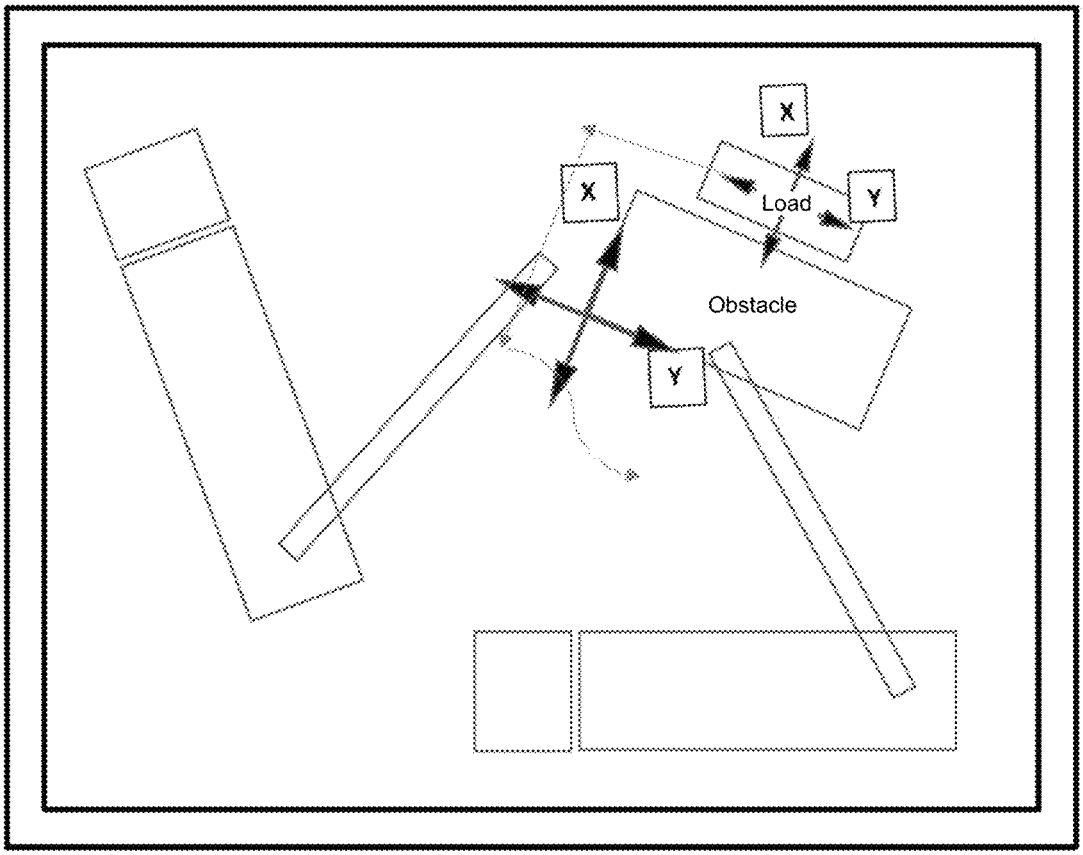
Figure 11B:
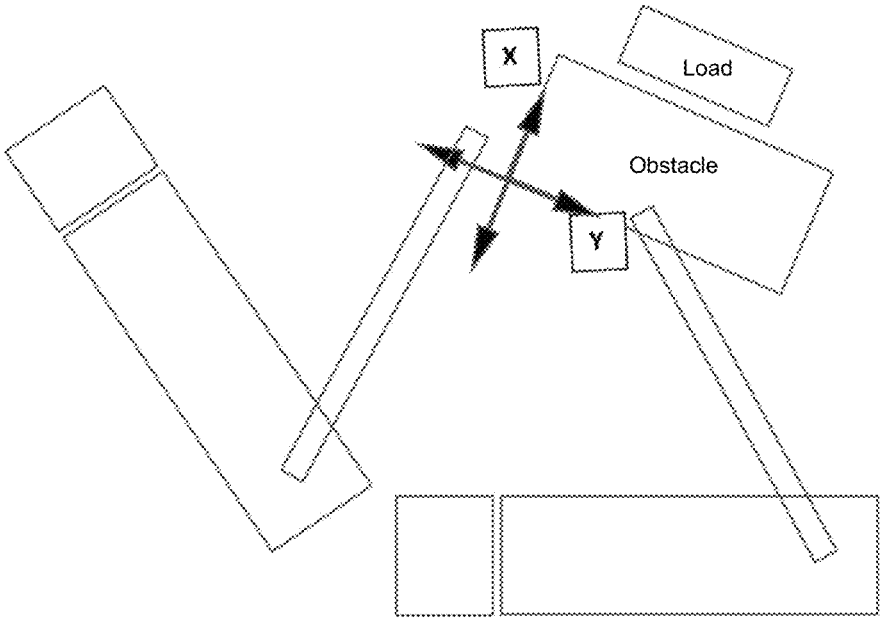
Figure 11C:
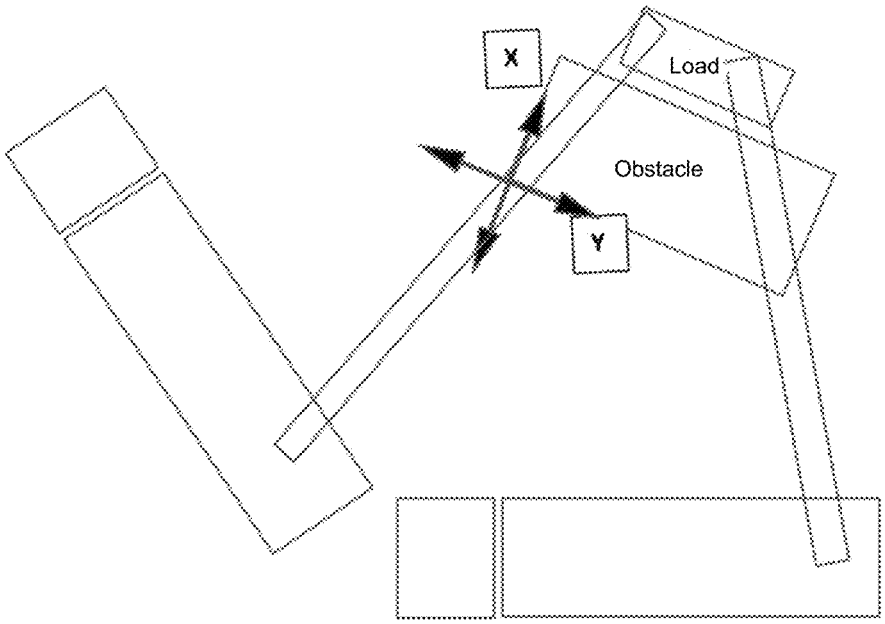

Further advantages, features, and details of the present invention will become clear with reference to the following description of the Figures. There are shown:

FIG. 1 shows a schematic representation for a straight-line traveling of a load, FIG. 2 shows a schematic representation of the plurality of coordinate systems at a crane, FIG. 3 shows a schematic representation of a travel profile in tandem operation, FIGS. 4A-4C how a first possibility of defining an obstacle coordinate system in crane operation, FIG. 5 shows a further possibility of defining the obstacle coordinate system, FIG. 6 shows a third possibility of defining the obstacle coordinate system, FIGS. 7A-7B show a fourth possibility of defining an obstacle coordinate system, FIGS. 8A-8 show visualized planning steps for moving a load, FIGS. 9A-9C show a visualized arrangement for hoisting a load, FIGS. 10A-10D show visualizations for the individual steps for hoisting a load in an obstacle coordinate system, FIGS. 11A-11C show a schematic representation of traveling a load in a tandem hoist in accordance with the present invention.

FIG. 1 shows a schematic representation or a straight-line traveling of a load along an edge of an obstacle. The crane operator here fixes the direction shown by an arrow and optionally the speed of the movement. The control then calculates how the individual axes and actuators of the crane are to be controlled so that the straight-line movement of the lifting hook or of the load is carried out. It is clear to the skilled person that other, non-straight line travel paths can also be traveled automatically such as circles or free-drawn lines. If the control is to find a plurality of solutions for implementing the travel path since, for example, the travel path can be achieved with the aid of a luffing movement or alternatively thereto by a telescopic movement, such an ambiguity can be resolved using different predefinable specifications. For instance, the maximum payload during the travel movement, a maximum travel speed, or a minimal energy consumption can inter alia be used to resolve such an ambiguity.

The origin coordinate system of the crane is furthermore also shown in FIG. 1 in which the longitudinal axis of the crane corresponds to the Y axis of this coordinate system. The origin of the coordinate system is typically on the axis of rotation of the superstructure of the crane.

The conversion carried out in the crane control, that carries out a straight-line movement in the obstacle coordinate system in corresponding controls of the axes and actuators of the crane, typically makes use of the means of coordinate transformation and also of coordinate system transformation.

FIG. 2 is a schematic representation that shows the plurality of coordinate systems at the crane or in its environment. The spatially fixed obstacle coordinate system 120 whose topographical or construction properties result in frequently demanding load movements is typically present at a deployment location of a crane, that is, at a construction site or the like.

There is furthermore also the crane-side origin coordinate system whose origin is as a rule at the slewing ring center. The hook block coordinate system 130 that is movable in accordance with the orientation and alignment of the hook block can be recognized as the third coordinate system shown in FIG. 2. It must furthermore be pointed out that the movement and the rotation of the hook block coordinate system 130 to the origin coordinate system 100 using the sensor system and the geometry of the components, which are both known to the crane control, can be calculated by the crane control. The crane control is therefore aware of the spatial relationship of the hook block coordinate system 130 with the origin coordinate system 100 at all times of operation.

The integration of the obstacle coordinate system is more problematic for the crane control here since the origin of this coordinate system changes its orientation and its location depending on the positioning of the crane at the deployment site. A positioning of the crane at the construction site planned in advance will always differ from the later actual implementation. An attempt could admittedly be made to position the crane at a previously measured point; however, this frequently fails due to the restricted maneuverability of the crane and due to other spatial constraints on a construction site. In addition, such an exact specification of the crane position is extremely laborious and would take up a lot of time.

It is therefore necessary to make the obstacle coordinate system 120 known to the crane control at the actual crane deployment location after the positioning of the crane so that the origin coordinate system can be brought into a spatial relationship with the obstacle coordinate system 120. The obstacle coordinate system 120 here must be redefined in the crane control (or the orientation and position of the obstacle coordinate system must be made known to the crane control) when the position of the crane (or of the origin coordinate system) changes.

The use of the obstacle coordinate system 120 is in particular of advantage when a travel movement is desired that is to take place along a straight line.

If all the coordinate systems are known in the crane control, such as shown with reference to FIG. 2, the hook block can be very simply traveled in the obstacle coordinate system by a distance of −12 m in the Y direction (of the obstacle coordinate system) and can subsequently be traveled by a distance of +5 m in the X direction (of the obstacle coordinate system). The hook block is here traveled by the different crane drives relative to its current position by the above-indicated distances in the obstacle coordinate system. It is clear to the skilled person that this is also possible in three-dimensional space when the Z axis required for this is added to the X axis and the Y axis.

Alternatively to this, it is also possible to indicate absolute points in the obstacle coordinate system that should be worked through by a travel movement of the hook block. It would thus be possible, for example, to define two spatial points that are arranged at the tips of the two movement arrows starting from the hook block to reach the desired travel destination.

FIG. 3 is a schematic representation of a tandem operation that provides for a plurality of crane hoists using at least two cranes. It is also of advantage here if the two cranes can make use of one and the same obstacle coordinate system. The control of the plurality of cranes can then be carried out very simply by an operator in the obstacle coordinate system without said operator having to be aware of the respective orientation of the crane to be controlled. Demanding travel paths are possible in tandem operation with the aid of the invention and require a very much smaller lead time. The error-prone simultaneous control by two crane operators during a tandem hoist is also no longer necessary.

FIGS. 4A to 4C represent a possibility of defining the obstacle coordinate system in crane operation. A camera is arranged at the boom head here that looks downwardly in the direction of the ground starting from the boom head. The location and the orientation of the hook block, or of the hook block coordinate system respectively, that is fixedly associated with the hook block, can be recognized by a transmission of this image of the camera to the crane control. The hook block coordinate system or the hook block itself can be positioned at the deployment location via the crane control such that a characteristic feature of the crane deployment location that is associated with the obstacle coordinate system and serves as the origin of the obstacle coordinate system are arranged congruently above one another or are brought into superposition, with the position of the hook block then being communicated to the crane control.

FIG. 4C shows by the thick arrow the path to be covered or covered by the hook block to map the obstacle coordinate system arranged at the edge of the obstacle as congruently as possible with the hook block coordinate system and to thus calibrate it in the origin coordinate system. The known block coordinate system is here duplicated in the camera image shown on the screen. This duplicate is suitably rotated and moved by means of user inputs such as via button operation. Once it is at the correct position (namely at the corner of the obstacle shown at which the obstacle coordinate system is already graphically shown), it becomes the obstacle coordinate system by a repeat user input. The crane control is then aware of the obstacles (buildings, special topographical features or the like) via the construction plan or via an operation schedule. As a result, it thereby becomes possible to input a possible travel path via the touchscreen of a crane control as a free curve in that the travel path is drawn in the crane image by a finger. In the Figures shown, a travel path drawn in this manner only relates to the preset installation height of the crane since the camera cannot itself detect the height. This could, however, be provided with the aid of an altitude sensor, for example.

The integration of the crane or of the origin coordinate system in the obstacle coordinate system here takes place via the reverse calculation of that position of the hook block at which the hook block coordinate system has been brought into superposition with the obstacle coordinate system with respect to position and orientation.

FIG. 5 shows a second possibility for making the obstacle coordinate system known to the crane control. For this purpose, travel again takes place with the origin of the hook block coordinate system to the origin of the obstacle coordinate system, with the orientations of the two coordinate systems not having to correspond with one another this time. This state is communicated to the crane control and a point on the X axis of the obstacle coordinate system is selected in a subsequent second step, with this likewise being communicated to the crane control. In a 3D system, the same is also done in a further step for a point of the Y axis of the obstacle coordinate system so that the crane control can calculate the correct orientation and the correct location of the obstacle coordinate system from it.

A third possibility for making the obstacle coordinate system known is shown in FIG. 6. At least one GPS transmitter 200 having radio transmission to the crane is used here that is at least partially active at predefined points at the construction site. The crane itself likewise has at least one GPS receiver that is configured to receive the signals of the GPS transmitters that are arranged at the obstacle. It is hereby possible to draw a conclusion on the obstacle coordinate system 120. It is clear to the skilled person that all global positioning systems are suitable for this purpose and not just GPS.

A compass in a portable radio remote control for the crane can likewise be used to make the orientation of the obstacle coordinate system and the origin coordinate system known to the crane control. This is shown by way of example with reference to FIGS. 7A and 7B. In this respect, the compass installed in the radio remote control is used in interaction with a compass 302 likewise present in the crane to determine the rotation of the crane and the remote control with respect to geographic north. This can be done, for example, in that the remote control is held with a reference surface 301 that is planar against a desired edge 315 at the obstacle (or is aligned in parallel therewith). The angle of rotation is subsequently saved by means of a button so that the rotation between the rotation relative to the crane and the stored rotational angle with respect to geographic north can be calculated using the rotations of the two.

It is thus achieved that travel can take place relatively in X or Y of the stored position by means of the master switch. It can, however, not be traveled absolutely here since no information on the movement of the two coordinate systems is known. The obstacle coordinate system is accordingly also not present with location and orientation in the crane control.

The case is also covered by the invention according to which a plurality of the above-shown possibilities for defining or making known the obstacle coordinate system are used.

FIGS. 8A to 8C show the procedure for traveling a load in the planning phase. An obstacle coordinate system is defined in an operation schedule that can run on a PC or also in the crane control (cf. FIG. 8A). The frame shown should here represent a display of the operation schedule program.

For this purpose, the obstacle coordinate system should be aligned at a point of the crane deployment location that is as obvious as possible so that in a later procedure, when the crane is actually on the construction site, the origin of the obstacle coordinate system can be relatively easily brought into superposition with the aid of the hook block. In the present case, there is a rectangle obstacle in which an edge should serve as the origin of the obstacle coordinate system. The longer of the two rectangle edges is here equal to the Y axis, the shorter of them is equal to the Y axis. The calibration later is accordingly facilitated by the use of the striking position on the construction site. A building corner or a building edge is particularly suitable here.

The position of the load with respect to the obstacle can then furthermore be defined in the operation schedule program.

FIG. 8 shows the positioning of a crane in the operation schedule program.

Following this step, the travel path of the crane and further intermediate points (attaching the load, rotating the load, etc.) are then defined, with this being able to take place with the aid of a touchscreen or of another input means. It is now possible to carry out a payload calculation in the operation schedule on the basis of the information thus provided. This naturally depends on the type of crane used.

Unlike FIGS. 8A to 8C, FIGS. 9A to 9C now show the actual position of the crane on a construction site. It can be recognized that it differs from the planned position in the operation schedule program, but this does not bring about any problems on the use of the invention. FIG. 9B shows the calibration of the obstacle coordinate system using one of the previously described possibilities. The crane control is thereby now aware of where the crane is to be arranged in the construction site plan that is fixedly linked to the obstacle coordinate system. Since the load is also indicated in the obstacle coordinate system, a repeat payload calculation can now take place whose result can naturally differ from the payload calculation carried out in the planning phase.

Once the payload calculation has been concluded with a positive result, the crane operator automatically travels the hook block to the starting point of the movement of the load. In so doing, he only regulates the speed with the aid of the master switch and checks that no unexpected collisions with obstacles occur. Once the hook block has arrived above the load to be moved, the load is attached. The crane operator then selects the travel path and specifies the speed by means of his control. The selected paths are then semi-automatically or fully automatically traveled through at the predefined speed (cf. FIG. 9C).

FIGS. 10A to 10D and 11A to 11C show the traveling of a load on a predefined load path in a tandem hoist.

First, the construction site environment is again shown in an operation schedule program, cf. FIGS. 10A to 10D. The frame shown should here represent a display of the operation schedule program. The position and the orientation of a load should furthermore be defined by means of a coordinate system (cf. FIG. 10A). An obstacle that is to be traveled around is furthermore also located on the construction site. It is therefore suitable to define an obstacle coordinate system, with again a striking point on the construction site being used to facilitate the calibration of the obstacle coordinate system in the crane control. In a similar manner as with a hoist using only one crane, the travel path of the load and possibly required intermediate points (attachment of the load, rotation of the load, etc.) also have to be defined in the subsequent planning step for the tandem hoist. This can be simply carried out by moving the load in the program.

FIG. 11A now shows the arrangement of the two cranes in the planning tool; the frame again stands for the representation in the operation schedule program. The lashing points of the load are defined here and assigned to a respective crane. The cranes are in the further procedure also defined so that the payload can be observed. A separate travel profile thus results for each crane to hold the load in the desired orientation and in the desired position at every point of the travel path.

It must be taken into account here that the travel paths are dependent on one another since the other crane has to adopt a specific position at each point of the one crane. It is of advantage for the calculation and for the entering of the travel path for the two travel paths of the cranes to relate to the obstacle coordinate system.

FIG. 11B and FIG. 11C now no longer show the planning tool, but rather the actual arrangement of the two cranes on a construction site. This does not have to take place exactly as provided in the planning tool.

Both cranes are now each separately calibrated for the obstacle coordinate system, with reference again being made to the methods provided further above for this purpose. A repeat payload calculation can then take place for the planned travel path of the respective crane. If the payload calculation does not produce any difficulties, both cranes move over the load into a position that enables a connection of the load to the respective cranes. Subsequently, the two cranes have to be coupled to one another so that they have a reliable data link to one another. One of the crane operators then takes over the speed control, with provision preferably being able to be made that the other crane operator has to release the load movement. This can be done, for example, with the aid of a button, the so-called dead man's switch. If the so-called dead man's switch is released by the second crane operator, both cranes stop.

Since the crane has different crane drives, that drive of a crane component that can carry out the movement the slowest determines the maximum speed to carry out the movement sequence.

The traveling of the load then takes place such that the first operator increases the speed and his crane starts to move. The crane in so doing transmits the X-Y coordinates of its position of the hook block in the obstacle coordinate system to the other crane. The other crane thereupon changes the position of its hook block using a corresponding regulation so that the desired orientation of the load and the desired movement of the load are achieved. The load is thus traveled as previously defined in master-slave operation. Both cranes stop automatically on too great a difference.

It is possible to carry out a particularly demanding tandem hoist reliably and precisely using the present invention.

The invention claimed is:

1. A method of moving a load using a crane, the method comprising:

defining an origin coordinate system in the crane, wherein the crane comprises a hook block for suspending the load therefrom, and wherein the crane is mobile and deployable to a deployment location for moving the load;

defining at least one obstacle coordinate system that is fixedly linked at least at times to the deployment location of the crane where the load is to be moved, wherein the at least one obstacle coordinate system corresponds to at least one obstacle to be avoided when moving the load suspended from the hook block;

establishing a relationship of the at least one obstacle coordinate system with the origin coordinate system after positioning of the crane at the deployment location, so that the origin coordinate system is brought into a spatial relationship with the at least one obstacle coordinate system, wherein establishing the relationship of the at least one obstacle coordinate system with the origin coordinate system comprises alignment of the hook block or a hook block coordinate system with at least one feature of the at least one obstacle;

predefining a travel path of the hook block with the suspended load with aid of the at least one obstacle coordinate system; and converting the travel path from the at least one obstacle coordinate system into actuator controls of the crane for a corresponding movement of the hook block and the suspended load, wherein convening the travel path into the actuator controls of the crane is performed by a crane control.

2. The method in accordance with claim 1, further comprising detecting a position and an orientation of the load to be moved in the at least one obstacle coordinate system.

3. The method in accordance with claim 1, wherein actuator controls for moving the load comprise an individual or common actuation of a luffing movement, of a hoisting movement, of a rotational movement of a superstructure of the crane, and/or a telescopic movement of a crane boom.

4. The method in accordance with claim 1, wherein, when the travel path to be converted is implementable using a plurality of actuator control sets, the actuator controls of the crane for the corresponding movement of the hook block are reached based on predetermined specifications, and wherein the predetermined specifications comprise a maximum payload, a maximum speed, and/or a minimal energy consumption.

5. The method in accordance with claim 1, wherein the origin coordinate system is furthermore fixedly linked to the crane; and wherein a spatial relationship of the origin coordinate system and the at least one obstacle coordinate system is made known to the crane control, with the origin coordinate system being at a center of a slewing ring of the crane.

6. The method in accordance with claim 5, wherein the hook block coordinate system is furthermore defined that is fixedly linked to the hook block of the crane, with a movement and a rotation of the hook block coordinate system being reverse calculated to the origin coordinate system fixedly linked to the crane.

7. The method in accordance with claim 6, wherein a camera is used at a boom head to detect the at least one obstacle coordinate system in the crane control; and wherein the hook block coordinate system is aligned and superposed with respect to the at least one obstacle coordinate system to make known the at least one obstacle coordinate system in the crane control of the crane.

8. The method in accordance with claim 7, wherein characteristic features of the deployment location, including a building edge or a special topical or construction feature at the deployment location, are used to align the hook block coordinate system at the at least one obstacle coordinate system.

9. The method in accordance with claim 7, wherein an origin of the hook block coordinate system is used to detect the at least one obstacle coordinate system in the crane control in order to make an origin of the at least one obstacle coordinate system and additionally a point of an axis on the at least one obstacle coordinate system known to the crane control of the crane with the crane control.

10. The method in accordance with claim 6, wherein a tandem hoist of two cranes is provided for the movement of the load; and origin coordinate systems of both cranes are transmitted into a common obstacle coordinate system.

11. The method in accordance with claim 10, wherein both cranes are coupled to one another before a traveling of the load via a data link that is used to transmit coordinates of the hook block of one crane in the common obstacle coordinate system to the other crane.

12. The method in accordance with claim 11, wherein a second crane of the two cranes moves a position of the hook block of the second crane in dependence on the coordinates in the common obstacle coordinate system of the hook block of a first crane of the two cranes and in dependence on a desired orientation of the load.

13. The method in accordance with claim 5, wherein radio GPS transmitters are used to detect the at least one obstacle coordinate system in the crane control that, in interaction with a radio GPS receiver present at the crane, permit the crane control of the crane to draw a conclusion on an orientation and a location of the at least one obstacle coordinate system.

14. The method in accordance with claim 1, wherein the crane is arranged in the at least one obstacle coordinate system before specification of the travel path of the load; and wherein a payload calculation of the crane furthermore takes place for a desired travel path after the specification of the travel path of the load.

15. An apparatus, comprising:

a crane for moving a load, wherein the crane comprises a book block for suspending the load therefrom, and wherein the crane is mobile and deployable to a deployment location for moving the load;

a crane control for controlling actuators of the crane; and the hook block comprising a coordinate system detection device for detecting a position and an orientation of the crane in a spatially fixed obstacle coordinate system that is fixedly linked to the deployment location of the crane where the load is to be moved, wherein the obstacle coordinate system corresponds to at least one obstacle to be avoided when moving the load suspended from the hook block; wherein the crane control is configured to perform the method of:

defining an origin coordinate system in the crane; and establishing a relationship of the obstacle coordinate system with the origin coordinate system after positioning of the crane at the deployment location, so that the origin coordinate system is brought into a spatial relationship with the obstacle coordinate system, wherein establishing the relationship of the obstacle coordinate system with the origin coordinate system comprises alignment of the hook block or a hook block coordinate system with at least one feature of the at least one obstacle; wherein the crane control is configured to travel the load on a basis of the detected position and orientation of the crane in the obstacle coordinate system, wherein the crane control is adapted to convert a travel path of the load with aid of the obstacle coordinate system into actuator controls.

16. The apparatus in accordance with claim 15, wherein the crane control is configured to carry out a payload calculation for a load detected in the obstacle coordinate system after the detection of the position and the orientation of the crane in the obstacle coordinate system.

17. The apparatus in accordance with claim 15, wherein, when the travel path to be converted is implementable using a plurality of actuator control sets, the crane control is adapted to determine the actuator controls of the crane for a corresponding movement of the load based on predetermined specifications, and wherein the predetermined specifications comprise a maximum payload, a maximum speed, and/or a minimal energy consumption.

* * * * *